US008487224B2

(12) United States Patent
Choi et al.

(10) Patent No.: US 8,487,224 B2
(45) Date of Patent: Jul. 16, 2013

(54) MICROWAVE OVEN

(75) Inventors: Sung-Ho Choi, Changwon (KR); Kyu-Young Kim, Changwon (KR); Jae-Myung Chin, Changwon (KR); Sang-Ryul Lee, Changwon (KR); Dong-Han Kim, Changwon (KR); Si-Young Choi, Changwon (KR)

(73) Assignee: LG Electronics Inc., Seoul (KR)

( * ) Notice: Subject to any disclaimer, the term of this patent is extended or adjusted under 35 U.S.C. 154(b) by 390 days.

(21) Appl. No.: 12/743,161

(22) PCT Filed: Nov. 17, 2008

(86) PCT No.: PCT/KR2008/006770

§ 371 (c)(1),
(2), (4) Date: Sep. 15, 2010

(87) PCT Pub. No.: WO2009/064150

PCT Pub. Date: May 22, 2009

(65) Prior Publication Data

US 2011/0049135 A1 Mar. 3, 2011

(30) Foreign Application Priority Data

Nov. 16, 2007 (KR) ..... 10-2007-0117551

(51) Int. Cl.
*H05B 6/64* (2006.01)

(52) U.S. Cl.
USPC ..... 219/725; 219/680; 99/331

(58) Field of Classification Search
USPC ..... 219/725, 680, 681, 685, 719, 706, 219/757, 400, 411–413, 494; 99/325, 329, 99/339, 330, 331, 437, 451, 467, 468, 476; 126/21 A
See application file for complete search history.

(56) References Cited

U.S. PATENT DOCUMENTS

| | | | | |
|---|---|---|---|---|
| 4,484,063 | A | 11/1984 | Whittenburg et al. | |
| 5,676,044 | A * | 10/1997 | Lara, Jr. | 99/331 |
| 2006/0131298 | A1 * | 6/2006 | Seuk Oh | 219/400 |
| 2008/0296292 | A1 * | 12/2008 | Byun | 219/680 |

FOREIGN PATENT DOCUMENTS

| | | | |
|---|---|---|---|
| KR | 10-2002-0041253 | A | 6/2002 |
| KR | 10-2007-0099548 | A | 10/2007 |
| WO | WO 2006/137675 | A1 | 12/2006 |

* cited by examiner

*Primary Examiner* — Quang Van
(74) *Attorney, Agent, or Firm* — Birch, Stewart, Kolasch & Birch, LLP

(57) ABSTRACT

A microwave oven is provided. A reinforcing part is provided to a multi-hole part for transferring the heat of a heater to a cooking chamber. This prevents deformation of the multi-hole part due to the heat of the heater.

8 Claims, 2 Drawing Sheets

MICROWAVE OVEN

TECHNICAL FIELD

The present disclosure relates to a microwave oven, and more particularly, to a microwave oven adapted to more efficiently cool components.

BACKGROUND ART

Microwave ovens are cooking appliances configured to cook foods using microwave and/or heat. Such a microwave oven includes an electronic component for generating microwave and/or a heater for generating heat. The microwave oven also includes a cooling system configured to cool the electronic component and/or the heater.

DISCLOSURE OF INVENTION

Technical Problem

An object of the present disclosure is to provide a microwave oven configured to prevent deformation of a multi-hole part for transferring heat of a heater.

Technical Solution

In one embodiment, a microwave oven includes: a cavity including a cooking chamber; a heater at a surface of the cavity; a heater cover covering the heater; a multi-hole part at the surface of the cavity, the multi-hole part transferring heat of the heater to the cooking chamber; and a reinforcing part protruding upward or downward in a manner where a portion of the mild-hole part has no end, from an imaginary plane where the multi-hole part is disposed, so as to reinforce the multi-hole part.

In another embodiment, a microwave oven includes: a cavity including a cooking chamber; a heater at a surface of the cavity; a heater cover covering the heater; a multi-hole part at the surface of the cavity, the multi-hole part transferring heat of the heater to the cooking chamber; and a reinforcing part protruding upward or downward in a manner where a portion of the multi-hole part is provided entirely in a closed curve shape, from an imaginary plane where the multi-hole part is disposed, so as to reinforce the multi-hole part.

ADVANTAGEOUS EFFECTS

According to embodiments, the damage of a multi-hole part is reduced.

BEST MODE FOR CARRYING OUT THE INVENTION

Hereinafter, a microwave oven according to an embodiment will now be described with reference to the accompanying drawings.

Figure 1:
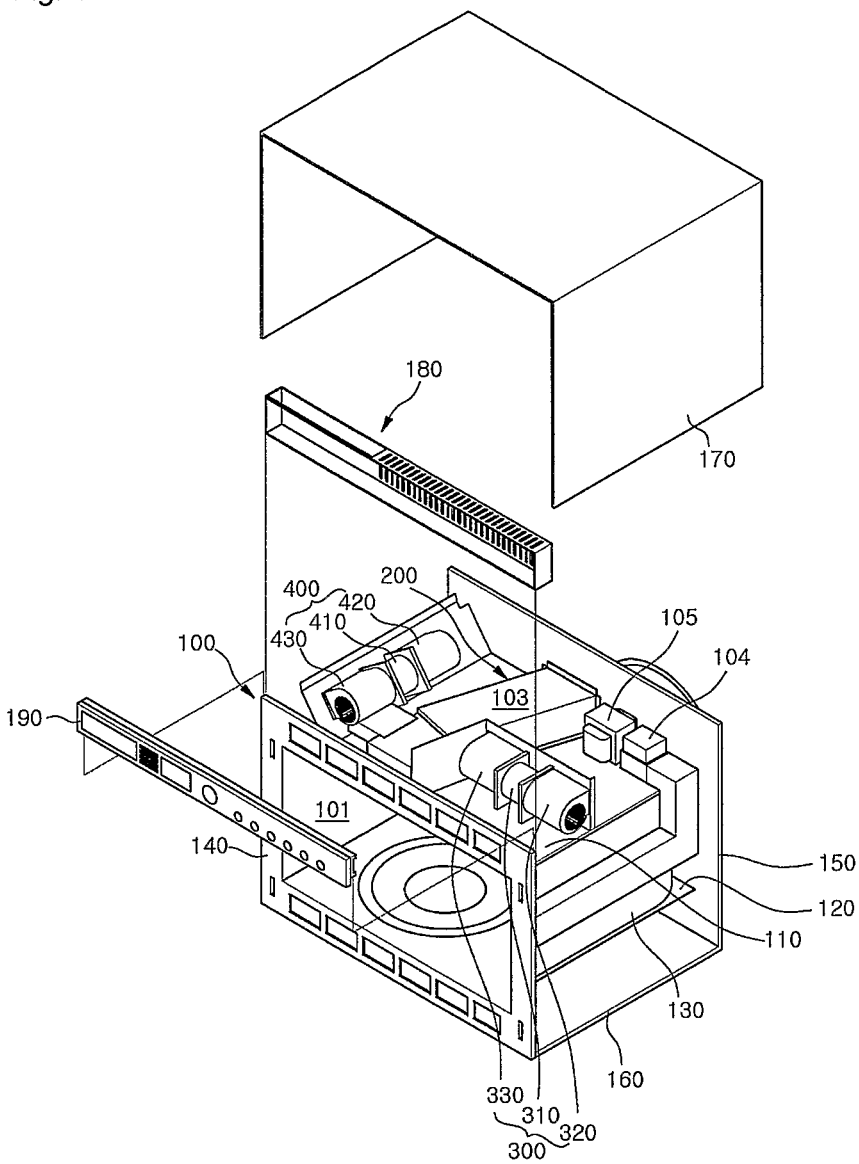
FIG. 1 is an exploded perspective view illustrating a microwave oven according to an embodiment.
Figure 2:
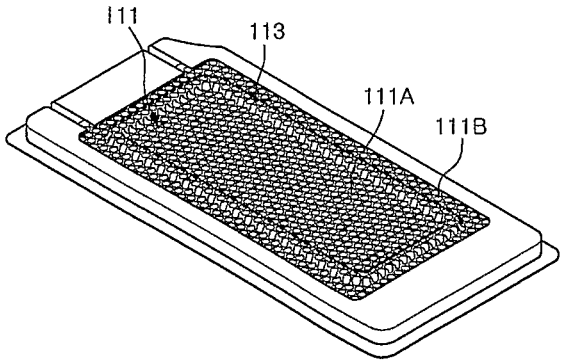
FIG. 2 is a perspective view illustrating a multi-hole part according to an embodiment.
Figure 3:
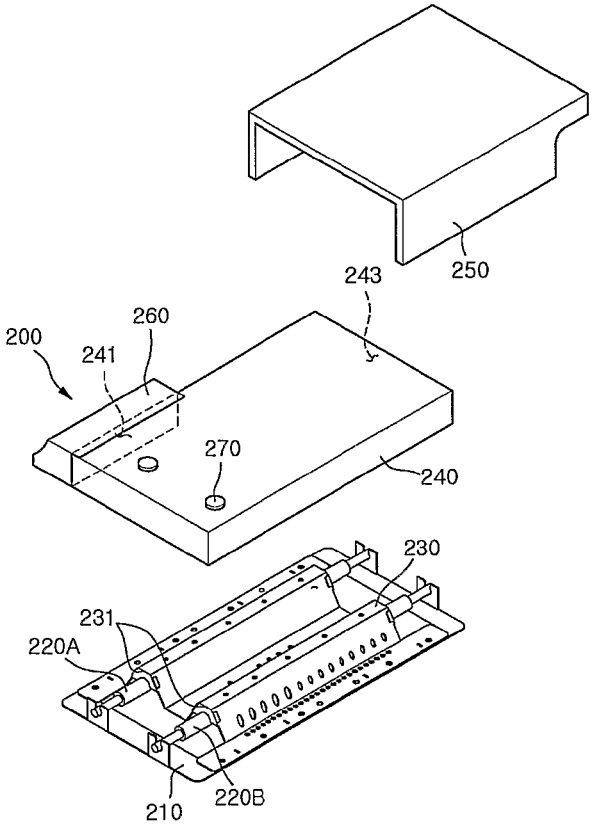
FIG. 3 is an exploded perspective view illustrating an upper heater assembly according to an embodiment.

FIG. 1 is an exploded perspective view illustrating the microwave oven according to the embodiment. FIG. 2 is a perspective view illustrating a multi-hole part 111 according to the embodiment. FIG. 3 is an exploded perspective view illustrating an upper heater assembly 200 according to the embodiment.

Referring to FIG. 1, a cavity 100 of the microwave oven has an upper surface, a bottom surface, and both side surfaces that are provided with an upper plate 110, a bottom plate 120, and an inner plate 130, respectively. The inner plate 130, having a C-shape opened entirely forward, includes a rear surface and a couple of side surfaces.

Front and rear ends of the cavity 100 are coupled with a front plate 140 and a back plate 150, respectively. The front plate 140 and the back plate 150 substantially define a front appearance and a rear appearance of the microwave oven. The front plate 140 and the back plate 150 respectively include rectangular plates extending out of the upper surface of the upper plate 110, the bottom surface of the bottom plate 120, and the side surfaces of the inner plate 130.

A lower portion of the cavity 100 is coupled with a base plate 160. Front and rear ends of the base plate 160 are fixed to a lower end of the front plate 140 and a lower end of the back plate 150. The base plate 160, coupled to the lower portion of the cavity 100, is spaced a predetermined distance from the bottom plate 120.

An upper portion and both sides of the cavity 100 are coupled with an outer case 170. The outer case 170 includes an upper surface and a couple of side surfaces, and has a C-shape opened entirely downward. In the state where the outer case 170 is coupled to the upper portion and both sides of the cavity 100, the upper surface and the side surfaces of the outer case 170 are spaced a predetermined distance from side surfaces of the upper plate 110 and the inner plate 130, respectively.

A cooking chamber 101 is disposed in the cavity 100. Substantially, a top surface, a bottom surface, a rear surface and both side surfaces of the cooking chamber 101 are provided by the upper plate 110, the bottom plate 120 and the rear and side surfaces of the inner plate 130, respectively. The cooking chamber 101 is a place where foods are cooked by microwaves and/or heat.

A space between the upper surfaces of the upper plate 110 and the outer case 170 includes an electronic chamber 103. The electronic chamber 103 is provided with electronic components for generating microwaves, the upper heater assembly 200 for generating heat, and a first and a second fan assemblies 300 and 400 for cooling the electronic components and the upper heater assembly 200. The electronic components include a magnetron 104 and a high voltage transformer 105.

The front end of the upper plate 110 is provided with an intake grill 180. The intake grill 180 is provided approximately in a flat hexahedron shape with an open front surface. The intake grill 180 guides the indoor air to the first fan assembly 300 and the second fan assembly 400.

The upper end of the front plate 140 is provided with a control panel 190. The control panel 190 receives various operating signals for the operation of the microwave oven, and displays information about the operation of the microwave oven.

Referring to FIG. 2, the electronic chamber 103 adjacent to the high voltage transformer 105, substantially, the left side of the fan housing 110 with respect to the drawing corresponding to the lower side of the upper heater assembly 200 is provided with the multi-hole part 111. The multi-hole part 111 of the upper plate 110 is provided entirely in a long rectangular shape in an inclined direction at a predetermined angle with respect to a longitudinal axis. The multi-hole part 111 of the upper plate 110 is covered with a heater glass (not shown).

The milt-hole part 111 includes a reinforcing part 113. The reinforcing part 113 prevents deformation of the multi-hole part 111 due to heat of the upper heater assembly 200. The reinforcing part 113 protrudes upward from the upper surface of the reinforcing part 113, so that a portion of the multi-hole part 111 is provided entirely in a closed curve shape. Thus, the reinforcing part 113 substantially has no end. Otherwise, microwaves concentrate on an end provided to the reinforcing part 113. In other words, since when the reinforcing part 113 is provided in an open curve shape, microwaves concentrate on both ends of the reinforcing part 113, the reinforcing part 113 provided in the closed curve shape prevents this concentration of microwaves. According to this embodiment, the reinforcing part 113 is provided entirely in a rectangular shape.

The multi-hole part 111 is divided by the reinforcing part 113. That is, the reinforcing part 113 in the closed curve shape divides the multi-hole part 111 into a first multi-hole part 111A and a second multi-hole part 111B. The first multi-hole part 111A corresponds to the inner portion of the reinforcing part 113 having the closed curve shape, and the second multi-hole part 111B corresponds to the outer portion of the reinforcing part 113 having the closed curve shape. In other words, the multi-hole part 111 that may be deformed by heat of the upper heater assembly 200 is divided by the reinforcing part 113. Thus, although the multi-hole part 111 is deformed by heat of the upper heater assembly 200, downward variation of the first and second multi-hole parts 111A and 111B due to the heat deformation is reduced relative to the entire variation of the multi-hole part 111.

The reinforcing part 113 may be provided to the upper heater assembly 200, and more particularly, to the rest of the multi-hole part 111 except for projections of heaters 220A and 220B that will be described later. The projections are provided vertically on the multi-hole part 111. Thus, the reinforcing part 113 itself is substantially less affected by heat of the heaters 220A and 220B.

The reinforcing part 113 divides the multi-hole part 111 into regions including the projections of the heaters 220A and 220B, and the other region. In other words, the first multi-hole part 111A corresponds to the region including the projections of the heaters 220A and 220B, and the second multi-hole part 111B corresponds to the other region except for the projections of the heaters 220A and 220B.

The upper heater assembly 200 is disposed on the electronic chamber 103 corresponding to the multi-hole part 111. The upper heater assembly 200 generates heat for radiation-heating foods in the cooking chamber 101.

Referring to FIG. 3, the upper heater assembly 200 according to this embodiment includes a heater supporter 210, the heaters 220A and 220B, a reflector 230, a first heater cover 240, a second heater cover 250, and a connection duct 260.

The heater supporter 210 is adapted to support the heaters 220A and 220B. The heater supporter 210 is provided in an approximately rectangular frame shape. The heater supporter 210, in the state of supporting the heaters 220A and 220B, is fixed to the upper surface of the upper plate 110 adjacent to the multi-hole part 111 of the upper plate 110.

The heaters 220A and 220B substantially generate heat. The heat from the heaters 220A and 220B heats foods in the cooking chamber 101 with radiation. According to this embodiment, the heaters 220A and 220B include a tube heater such as a halogen heater. Since the tube heater has a greater heating value than other heaters such as a sheathe heater and a ceramic heater, foods are cooked more efficiently. When the upper heater assembly 200 is provided to the upper plate 110, that is, when the heater supporter 210 is fixed to the upper plate 110, the heaters 220A and 220B are disposed longitudinally. The heaters 220A and 220B may be inclined at a predetermined angle with respect to the longitudinal axis, like the multi-hole part 111.

The reflector 230 reflects heat of the heaters 220A and 220B to the cooking chamber 101. The reflector 230 is provided with a couple of recesses 231 respectively surrounding the outer surfaces of the heaters 220A and 220B. The recesses 231 are recessed upward, so that a portion of the reflector 230 has an approximately trapezoid cross section, and the recesses 231 are transversely spaced from each other with respect to the drawing. The recesses 231 are provided with a plurality of cooling holes 233. The cooling holes 233 are adapted to cool the heaters 220A and 220B.

The first heater cover 240 covers the heaters 220A and 220B, and the reflector 230 supported by the heater supporter 210. The second heater cover 250 prevents heat of the heaters 220A and 220B from being transferred to the electronic components. To this end, the second heater cover 250 covers one portion of the first heater cover 240 adjacent to the high voltage transformer 105.

The connection duct 260 connects the second fan assembly 400 to the first heater cover 240. To this end, the both ends of the connection duct 260 communicate with a discharge part (not shown) of the second fan assembly 400, and an entrance 241 of the first heater cover 240, respectively.

Hereinafter, the operation of the microwave oven according to the embodiment will now be described in more detail.

First, heat of the upper heater assembly 200, and more particularly, heat of the heaters 220A and 220B is transferred through the multi-hole part 111 into the cooking chamber 101. Thus, a food is cooked in the cooking chamber 101 using the heat of the heaters 220A and 220B.

Since the multi-hole part 111 is reinforced by the reinforcing part 113, a phenomenon is prevented where the heat of the heaters 220A and 220B deforms the multi-hole part 111 and thus the multi-hole part 111 sags downward because of its weight.

Microwave, generated from the magnetron 104, together with the heat of the heaters 220A and 220B may be irradiated into the cooking chamber 101. Then, the food is cooked with the heat and the microwave.

According to this embodiment, the reinforcing part 113 is provided in the closed curve shape, that is, in a curve without an end. This prevents the phenomenon where the microwave concentrating on one side of the reinforcing part 113 damages the reinforcing part 113. Also, since the damage of the reinforcing part 113 is prevented, although the heaters 220A and 220B heat the multi-hole part 111, the reinforcing part 113 prevents the sagging of the multi-hole part 111 due to the heating.

MODE FOR THE INVENTION

Hereinafter, microwave ovens according to other embodiments will now be described in more detail with reference to the accompanying drawings.

Figure 4:
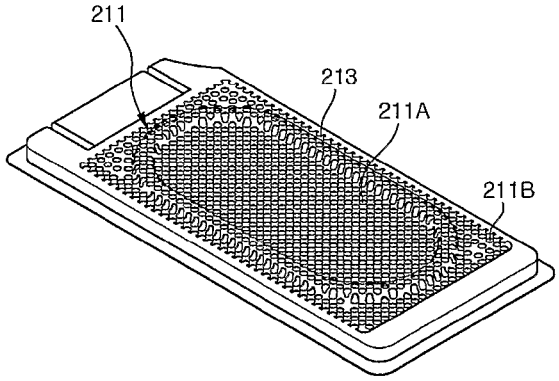
FIG. 4 is a perspective view illustrating a multi-hole part of a microwave oven according to another embodiment.
Figure 5:
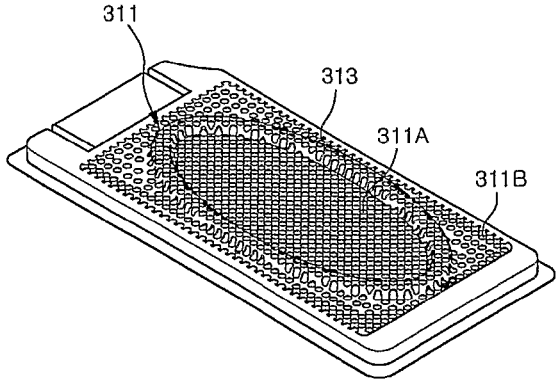
FIG. 5 is a perspective view illustrating a multi-hole part of a microwave oven according to further another embodiment.

FIG. 4 is a perspective view illustrating a multi-hole part 211 of the microwave oven according to one embodiment. FIG. 5 is a perspective view illustrating a multi-hole part 311 of the microwave oven according to another embodiment.

Referring to FIG. 4, a reinforcing part 213 included in the multi-hole part 211 has an oval shape. Referring to FIG. 5, a reinforcing part 313 included in the multi-hole part 311 has a track shape. The reinforcing parts 213 and 313 according to the embodiments of FIGS. 4 and 5 are provided in a closed curve shape, like the reinforcing part 113 of the previous embodiment. The reinforcing parts 213 and 313 are provided to the rests of the multi-hole parts 211 and 311 except for projections of the heaters 220A and 220B (refer to FIG. 3) provided vertically on the multi-hole parts 211 and 311. Thus, the reinforcing parts 213 and 313 respectively separate the multi-hole parts 211 and 311 into first multi-hole parts 211A and 311A corresponding to the regions including the projections of the heaters 220A and 220B, and second multi-hole parts 211B and 311B corresponding to the regions except for the projections of the heaters 220A and 220B.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

Industrial Applicability

The microwave oven according to the embodiments provides the reinforcing part in the closed curve shape having no end, to the multi-hole part adapted to transfer heat of the heater to the cooking chamber. Since this prevents microwaves from concentrating on the multi-hole part, the thermal deformation of the multi-hole part is reduced even when a high output heat such as a halogen lamp is used.

The invention claimed is:

1. A microwave oven comprising:

an electronic chamber in which a heater for generating heat is disposed;

a cooking chamber where foods are cooked;

a multi-hole part disposed between the electronic chamber and the cooking chamber, the multi-hole part comprising a plurality of holes to transfer the heat generated by the heater to the cooking chamber; and a reinforcing part protruding from at least one portion of the multi-hole part in a direction opposite to a direction of transfer of the heat, wherein the reinforcing part is formed to have a closed curve shape, and wherein the reinforcing part comprises a plurality of holes.

2. The microwave oven according to claim 1, wherein the reinforcing part is provided in one of a rectangular shape, an oval shape, and a track shape.

3. The microwave oven according to claim 1, wherein the heater comprises at least one halogen heater.

4. The microwave oven according to claim 1, further comprising a reflector reflecting the heat of the heater to the cooking chamber.

5. The microwave oven according to claim 1, further comprising a cooling member configured to cool the heater.

6. The microwave oven according to claim 1, wherein the reinforcing part divides the multi-hole part into an inner portion and an outer portion with respect to the reinforcing part.

7. The microwave oven according to claim 1, wherein the reinforcing part divides the multi-hole part into a projection of the heater provided to the multi-hole part in a direction in which the heat of the heater is transferred into the cooking chamber, and a rest except for the projection of the heater.

8. The microwave oven according to claim 1, wherein the heater comprises at least one tube heater.

* * * * *